US009623343B2

(12) United States Patent
Payne

(10) Patent No.: US 9,623,343 B2
(45) Date of Patent: Apr. 18, 2017

(54) TOY VEHICLE PLAY SET WITH AIRBRUSH

(71) Applicant: Mattel, Inc., El Segundo, CA (US)

(72) Inventor: Julian Payne, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/500,035

(22) Filed: Sep. 29, 2014

(65) Prior Publication Data

US 2015/0093960 A1 Apr. 2, 2015

Related U.S. Application Data

(60) Provisional application No. 61/885,627, filed on Oct. 2, 2013.

(51) Int. Cl.

*A63H 33/30* (2006.01)
*A63H 33/22* (2006.01)
*A63H 17/44* (2006.01)

(52) U.S. Cl.

CPC ..... *A63H 33/22* (2013.01); *A63H 17/44* (2013.01)

(58) Field of Classification Search

CPC ..... A63H 33/30
USPC ..... 446/424
See application file for complete search history.

(56) References Cited

U.S. PATENT DOCUMENTS 1,349,154 A * 8/1920 Holton ..... B05B 7/0815 239/290
1,501,432 A * 7/1924 Allen ..... B05B 7/2435 239/340
1,613,588 A * 1/1927 Gradolph ..... B05B 7/0815 239/301
1,703,219 A * 2/1929 Wold ..... B05B 7/0815 239/300
2,139,133 A * 12/1938 Paasche ..... B05B 7/0815 239/298
2,262,977 A * 11/1941 Vasil ..... A45D 29/004 132/285
2,875,553 A * 3/1959 Morgan ..... A63H 1/22 273/155
3,168,250 A * 2/1965 Paasche ..... B05B 7/066 239/300
3,542,366 A * 11/1970 Schocker ..... A63H 18/028 104/55

(Continued)

FOREIGN PATENT DOCUMENTS

GB 2288151 A 10/1995
GB WO 2007020418 A1 * 2/2007 ..... A63H 33/22

OTHER PUBLICATIONS

U.S. Appl. No. 14/500,035, Payne, Dolores Collins.*

*Primary Examiner* — Aarti B Berdichevsky
*Assistant Examiner* — Dolores Collins
(74) *Attorney, Agent, or Firm* — Edell, Shapiro & Finnan, LLC

(57) ABSTRACT

The present invention relates to a toy vehicle play set with a chamber, a moveable platform, a resilient stencil, and an airbrush. The platform is configured to move from within the chamber to the top surface of the chamber. Moreover, the resilient stencil is configured to be placed over the platform, and any object on the platform, when the platform has been raised. The resilient stencil is configured to be pliable and contain a series of apertures that create a design. The airbrush is then configured to spray ink onto the stencil and object beneath the stencil, coloring the design of the stencil onto the object.

20 Claims, 14 Drawing Sheets

(56) References Cited

U.S. PATENT DOCUMENTS 3,834,070 A * 9/1974 Breslow ..... A63H 13/15 33/27.11
4,023,524 A * 5/1977 Goldfarb ..... A63H 33/22 101/114
4,269,874 A 5/1981 Pryor et al.
4,356,657 A * 11/1982 Goldfarb ..... A63H 33/3061 446/236
4,425,735 A * 1/1984 Kulesza ..... A63H 18/028 446/28
4,516,953 A * 5/1985 Hippely ..... A63H 18/028 238/10 E
4,549,243 A 10/1985 Owen et al.
4,558,867 A * 12/1985 Hippely ..... A63H 18/028 273/412
4,685,622 A * 8/1987 Shimohira ..... B05B 7/066 239/346
5,131,598 A * 7/1992 Hoogeveen, Jr. ..... B05B 3/087 239/214
5,156,684 A 10/1992 Mayer et al.
5,190,220 A * 3/1993 Bolton ..... B05B 7/2429 222/209
5,195,893 A 3/1993 Casale
5,242,496 A * 9/1993 Handy ..... B05B 13/0228 118/320
5,322,220 A 6/1994 Rehkemper
5,533,900 A 7/1996 Volk
5,586,923 A * 12/1996 Hippely ..... A63H 17/008 446/14
5,687,886 A 11/1997 Bolton
5,842,646 A * 12/1998 Kitajima ..... B05B 7/2459 239/345
5,871,385 A 2/1999 Hippely et al.
6,024,300 A 2/2000 Bolton
6,270,021 B1 8/2001 Bolton
6,283,388 B1 9/2001 Bolton
6,322,416 B1 * 11/2001 Burke ..... A63H 33/22 446/175
6,394,598 B1 5/2002 Kaiser
6,422,698 B2 7/2002 Kaiser
6,609,457 B1 8/2003 De Laforcade
6,892,960 B2 * 5/2005 Ptak ..... B05B 7/2416 239/346
7,121,196 B2 10/2006 Mellis
7,222,803 B2 5/2007 Bolton
7,607,591 B2 10/2009 Barch et al.
7,628,673 B2 * 12/2009 Bedford ..... A63H 18/025 446/444
8,002,202 B2 8/2011 Ginelli et al.
8,052,072 B2 11/2011 Kriesmair
8,096,489 B2 * 1/2012 Fedorov ..... B05B 1/3013 239/345
8,591,284 B2 * 11/2013 Dubois ..... A63H 3/52 446/423
8,777,690 B2 * 7/2014 Zhou ..... A63H 3/52 446/478
8,846,337 B2 * 9/2014 Schann ..... B05B 15/045 435/34
8,852,884 B2 * 10/2014 Schann ..... B05B 15/045 435/34
8,951,091 B2 * 2/2015 Payne ..... A63H 17/26 446/429
2004/0079817 A1 4/2004 Chang
2006/0078684 A1 4/2006 Neo et al.
2007/0048065 A1 3/2007 Schmidt et al.
2007/0054594 A1 * 3/2007 Schmidt ..... A63H 33/22 446/424
2007/0128972 A1 6/2007 Schmidt et al.
2010/0075573 A1 * 3/2010 Dubois ..... A63H 17/44 446/465
2010/0304639 A1 12/2010 Payne et al.
2011/0014844 A1 * 1/2011 Henson ..... A63H 17/00 446/85
2012/0045965 A1 * 2/2012 Zhou ..... A63H 3/52 446/478
2013/0052906 A1 2/2013 Payne
2013/0078887 A1 * 3/2013 Payne ..... A63H 17/26 446/429

* cited by examiner

TOY VEHICLE PLAY SET WITH AIRBRUSH

CROSS-REFERENCE TO RELATED APPLICATION

This application claims priority to and is based on U.S. Provisional Patent Application No. 61/885,627, filed Oct. 2, 2013, entitled "Toy Vehicle Play Set With Airbrush," the entire disclosure of which is incorporated by reference herein.

FIELD OF THE INVENTION

The present invention relates to a toy vehicle play set, and in particular, a toy vehicle play set with stencils and an airbrush. Specifically, the stencils are configured to be placed over the toy vehicles and sprayed with the airbrush to leave a design on the toy vehicles.

BACKGROUND OF THE INVENTION

Various toy vehicle play sets are known. However, many of these toy vehicle play sets are only used to simulate raceways, cityscapes, or other backdrops. Many of these toy vehicle play sets allow the toy vehicles to move freely about the toy vehicle play sets. Furthermore, various airbrushes that utilize markers are known. These airbrushes enable a user to spray items with ink from the markers within the airbrush. However, these airbrushes are often messy and difficult use to spray certain patterns on objects. Moreover, if stencils are utilized to spray designs on objects, they may be often held down by a user's fingers, which results in a user inadvertently spraying their fingers with the airbrush or accidentally moving the stencil when spraying it with the airbrush. In addition, after spraying an object with the airbrush, a user may have to wait a prolonged period of time to use the object because the ink takes time to dry.

Thus, there is a need for a toy vehicle play set that allows toy vehicles to interact with the play set and be sprayed by the airbrush. Furthermore, there is a need for a toy vehicle play set with stencil designs that can be overlaid on the toy vehicles to be sprayed by the airbrush to leave designs on the toy vehicles. In addition, there is a need for a toy vehicle play set that secures the toy vehicles and the stencils over the toy vehicles when the toy vehicles are to be sprayed. Finally, there is a need for a toy vehicle with a device or mechanism for quickly drying the ink that is sprayed onto the toy vehicle.

SUMMARY OF THE INVENTION

In one embodiment, a play set for toy vehicles includes a chamber, a platform movably coupled to the chamber, a frame pivotally coupled to the chamber, and a resilient membrane removably coupled to the frame. The chamber defines an interior and an exterior, and includes a top surface with an aperture disposed on the top surface. Furthermore, the platform is movably coupled to the chamber and configured to move between a lowered position and a raised position. When in the lowered position, the platform is positioned in the interior of the chamber, and when in the raised position, the platform is positioned within the aperture on the chamber. Moreover, the frame is pivotally coupled to the top surface of the chamber at a location proximate to the aperture. The frame is pivotable between an open position and a closed position, where the frame is positioned over the aperture. In addition, the resilient membrane is removably coupled to the frame so that when the frame is in the closed position, the resilient membrane is positioned over and covers the aperture on the top surface of the chamber.

In one embodiment, the invention relates to a play set comprising a housing; a frame pivotally coupled to the housing, the frame being pivotal between an open position and a closed position where an object can be positioned beneath the frame; and a resilient membrane coupled to the frame, the resilient member laying over the object when the frame is in the closed position.

In an alternative embodiment, the resilient membrane is removably coupled to the frame. In another embodiment, the frame includes several projections and the resilient membrane includes several openings, each of the openings receive a projection when the resilient membrane is coupled to the frame. In another embodiment, the resilient membrane further comprises a series of apertures that, when viewed together, create a design. In another embodiment, the resilient member is configured to stretch and deform over the object when the frame is in the closed position.

In another embodiment, the invention relates to a play set for toy vehicles, comprising: a housing; a platform coupled to the housing, the platform being configured to receive a toy vehicle thereon; a frame movably coupled to the housing, the frame being movable between an open position and a closed position relative to the housing; and a resilient membrane removably coupled to the frame, the resilient member being configured to stretch and deform over the toy vehicle on the platform, the resilient membrane defining at least one opening through which a material may contact the toy vehicle.

In an alternative embodiment, the housing includes an opening formed therein, the platform is located proximate to the opening of the housing, and the frame is located proximate to the opening of the housing. In another embodiment, the resilient membrane includes several mounting openings and the frame includes several projections, each of the projections being inserted into one of the mounting openings of the resilient membrane when the resilient membrane is coupled to the frame. In another embodiment, the play set includes an airbrush coupled to the chamber, the airbrush configured to spray ink from a marker inserted into the airbrush. In another embodiment, the resilient membrane further comprises a series of apertures that, when viewed together, create a design.

BRIEF DESCRIPTION OF THE DRAWINGS

Like reference numerals have been used to identify like elements throughout this disclosure.

DETAILED DESCRIPTION OF THE INVENTION

Figure 1:
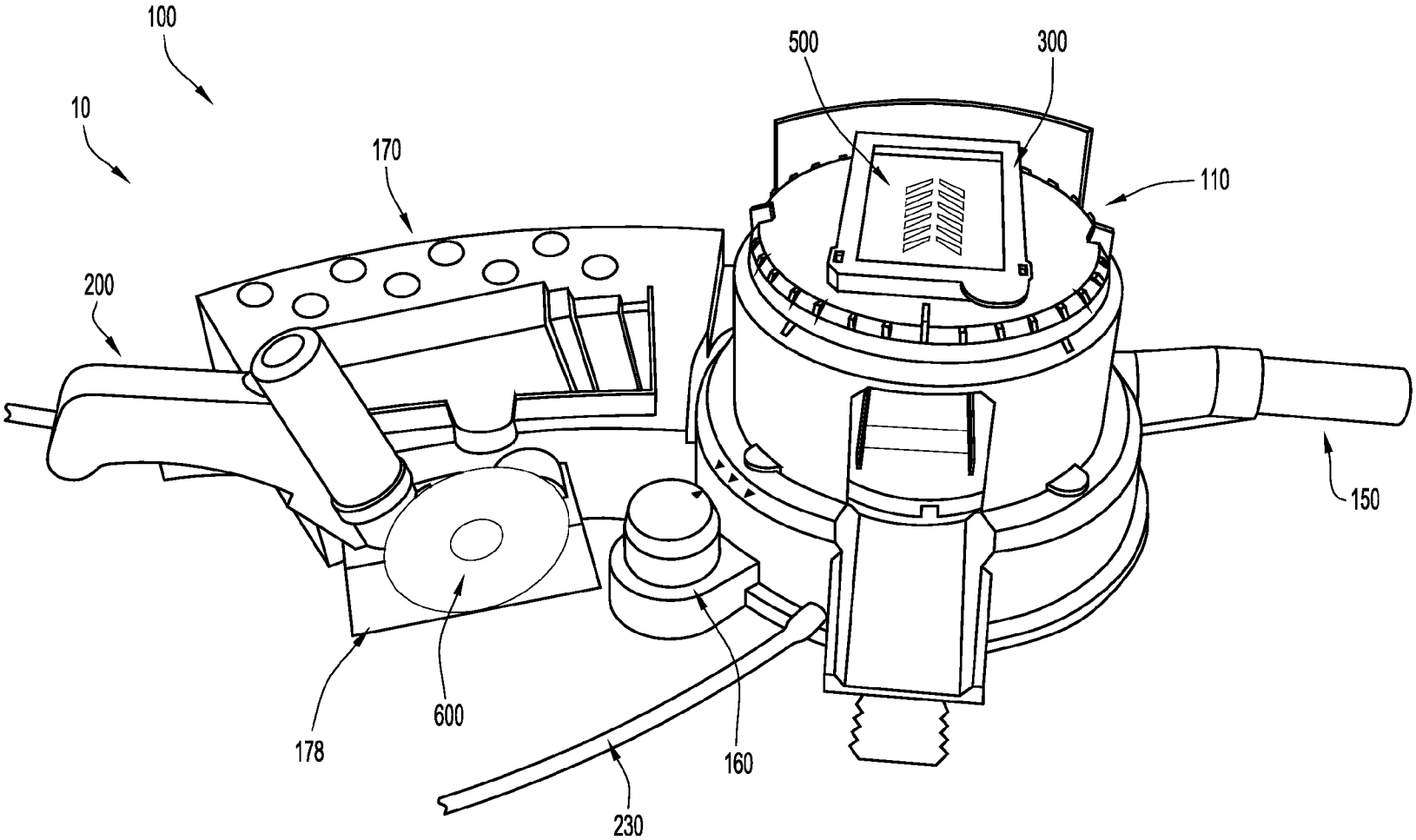
FIG. 1 illustrates a top view of a first embodiment of the toy vehicle play set in accordance with the present invention.

Illustrated in FIG. 1 is a toy vehicle play set 10, that includes a base 100, an airbrush 200, a stencil frame 300 pivotally coupled to the base 200, a resilient stencil 500 removably coupled to the stencil frame 300, and a circular stencil 600 removably coupleable to the airbrush 200. The toy vehicle play set 10 is sized and configured to be used with children's toy vehicles. The toy vehicle play set 10 enables a user to use the airbrush 200 to apply ink from markers 800 onto the toy vehicles 700. A user can use one of the resilient stencil 500 or the circular stencil to apply designs to the outer surface of a toy vehicle 700, creating a new "paint job" for the toy vehicle. The toy vehicle play set 10 enables a user to customize their toy vehicles 700 with multiple different designs and colors.

Figure 2:
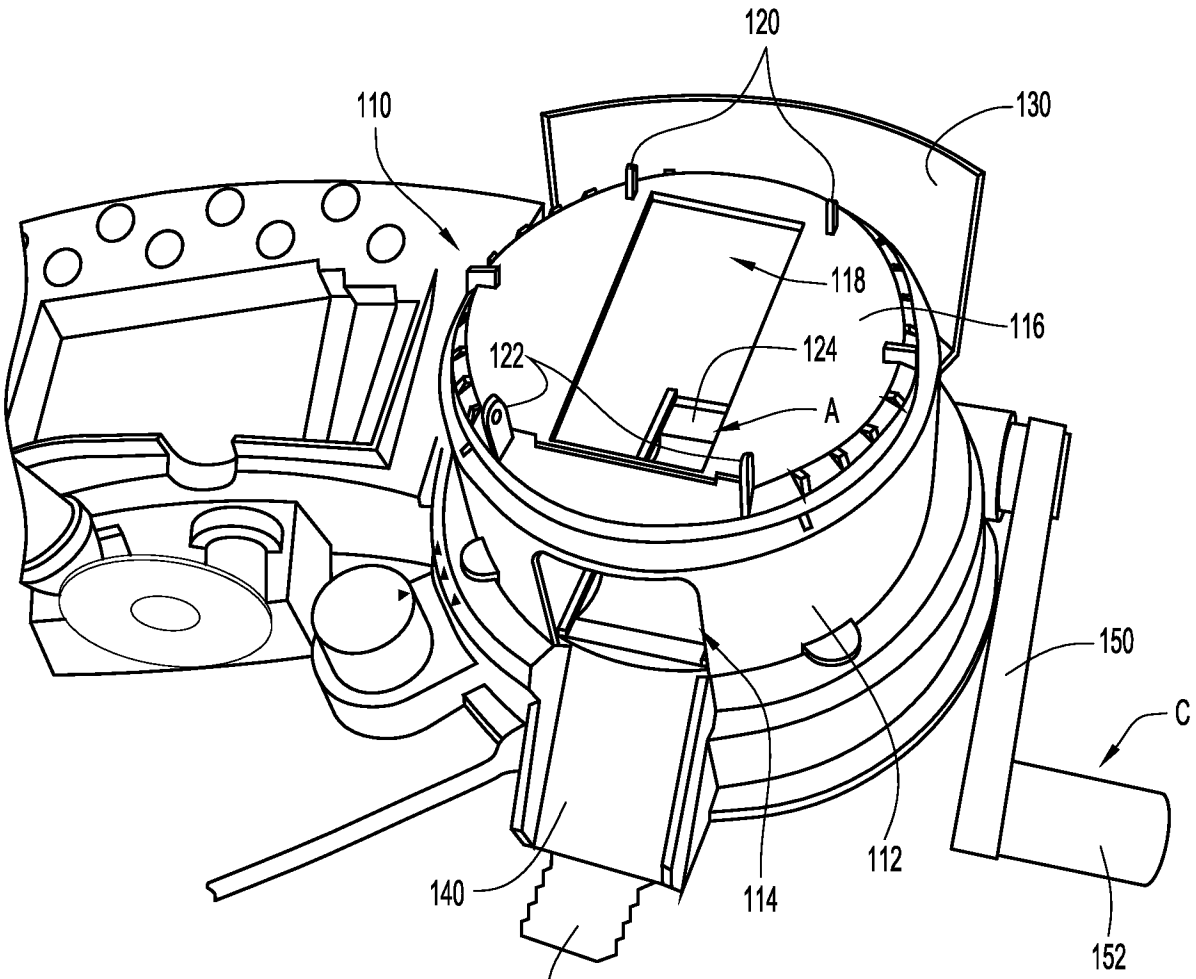
FIG. 2 illustrates a perspective view of the chamber according to the embodiment of the toy vehicle play set of FIG. 1, the platform and crank arm being in the lowered position.
Figure 3:
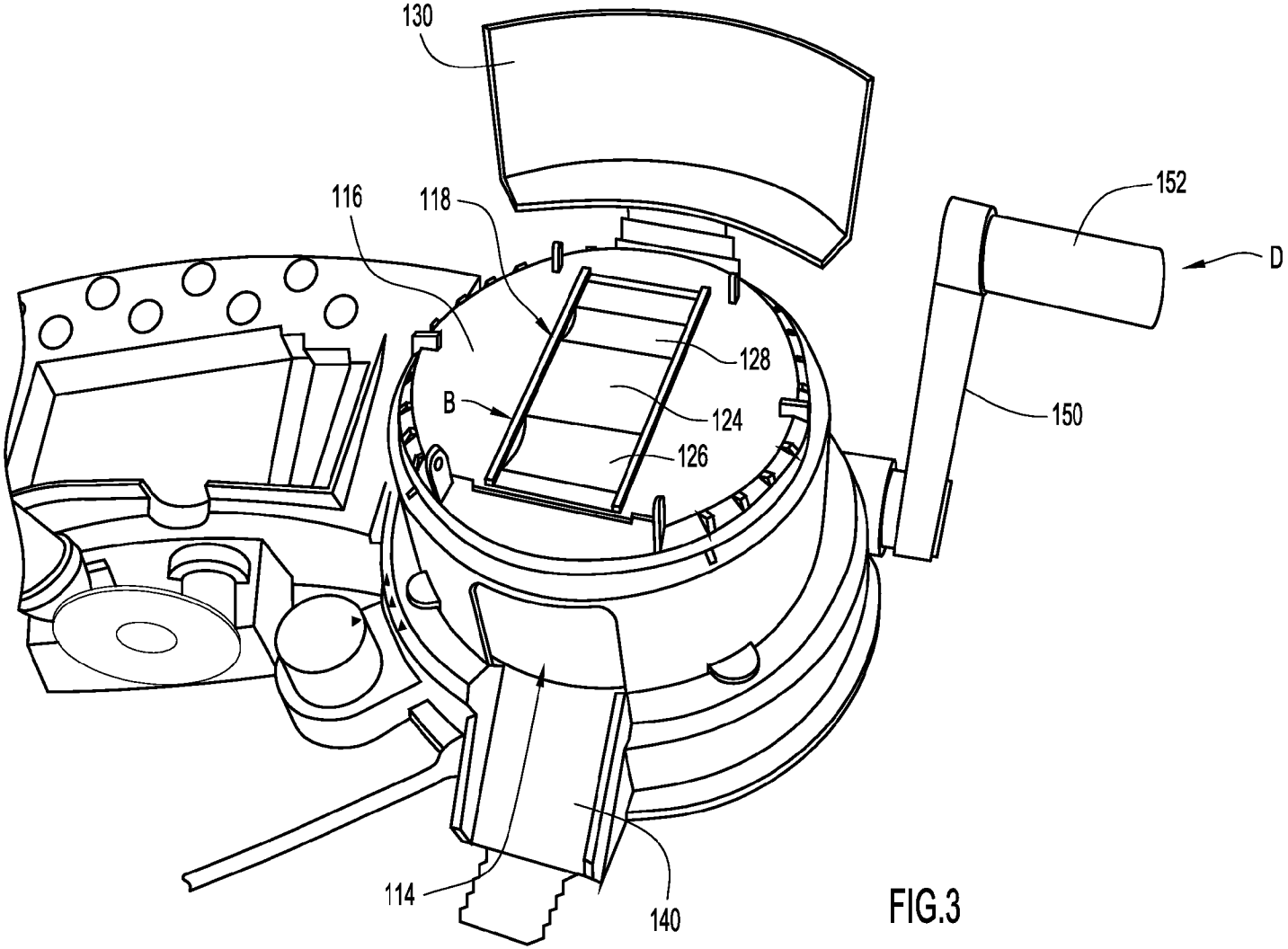
FIG. 3 illustrates a perspective view of the chamber according to the embodiment of the toy vehicle play set of FIG. 1, the platform and crank arm being in the raised position.

As illustrated in FIG. 1, the base 100 includes a chamber 110 forming one side of the base 100, and a holder 170 coupled to the chamber 110, the holder 170 forming the other side of the base 100. As illustrated in FIGS. 2 and 3, in this embodiment, the chamber 110 is substantially cylindrical in shape. However, in other embodiments, the chamber 110 may be shaped differently, such as substantially rectangular. The chamber 110 includes sidewall 112 that forms the cylindrical shape of the chamber 110. Moreover, the sidewall 112 includes a first opening 114 oriented toward the front of the chamber 110. The first opening 114 enables a toy vehicle 700 to be placed within the interior of the chamber 110. As illustrated in FIG. 2, a ramp 140 is aligned with the opening 114. The ramp 140 includes a tongue 144 that is configured to frictionally receive a track portion. The combination of the ramp 140 and a connectable track portion allows a user to simulate driving the toy vehicle 700 into the chamber 110 for the toy vehicle 700 to receive a new paint job.

Figure 5:
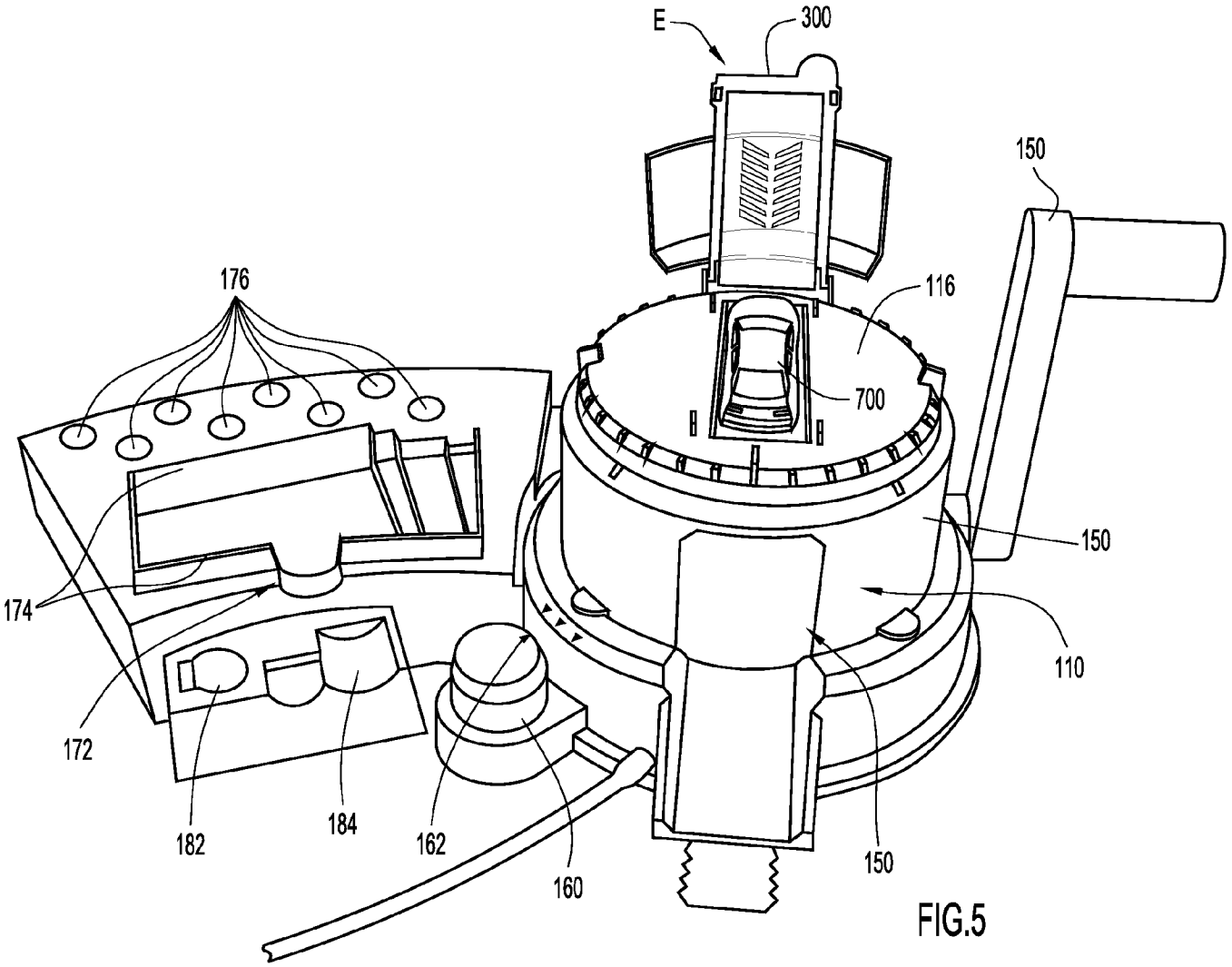
FIG. 5 illustrates a top view of the base according to the embodiment of FIG. 1, the stencil frame being in the opened position.
Figure 6:
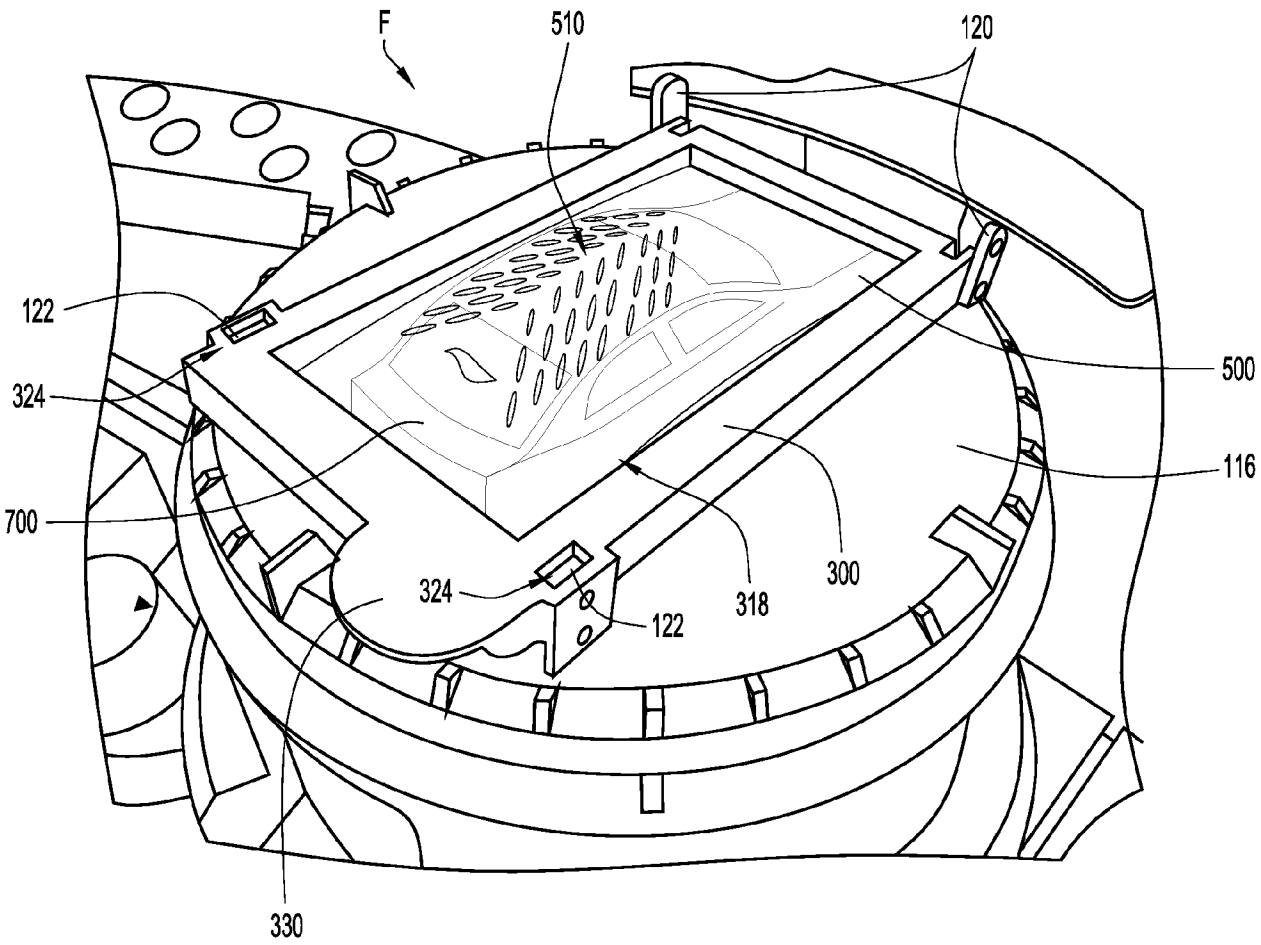
FIG. 6 illustrates a perspective view of the top of the chamber according to the embodiment of the toy vehicle play set of FIG. 1, the stencil frame being in the closed position.

Furthermore, the chamber 110 includes a top surface 116 that encloses the interior of the chamber 110. In some embodiments, the top surface 116 is configured to rotate with respect to the sidewall 112 about a vertical axis. As illustrated, the top surface 116 of the chamber 110 includes a second opening 118. In this embodiment, the second opening 118 has a substantially rectangular shape. As illustrated in FIGS. 2 and 3, the second opening 118 is positioned on the top surface 116 lengthwise from front to back. In other words, one end of the second opening 118 is positioned over the first opening 114 in sidewall 112, with the second end of the second opening 118 positioned proximate to the spray guard 130. Extending upwardly from the top surface 116 is a set of two extensions 120 proximate to the end of the second opening 118 that is proximate to the spray guard 130. Additionally, a set of two protrusions 122 extend upwardly from the top surface 116 proximate to the end of the second opening 118 that is positioned over the first opening 114. As later explained, the extensions 120 and protrusions 122 enable the stencil frame 300, as best illustrated in FIGS. 5 and 6, to be pivotally connected proximate to the second opening 118.

Furthermore, as illustrated in FIGS. 2 and 3, a platform 124 is movably positioned within the chamber 110 between a lowered position A and a raised position B. A crank arm, or lever, 150 which is rotatably coupled to the base of chamber 110, is operatively coupled to the platform 124 to move the platform between lowered position A and raised position B. As illustrated in FIG. 2, the platform 124 is positioned in the lowered position A. When in the lowered position A, the platform 124 is aligned with the first opening 114 in the sidewall 112, so that when toy vehicles 700 enter the chamber 110 through the first opening 114, the toy vehicles 700 are positioned on the platform 124. Furthermore, FIG. 2 illustrates the crank arm 150 in the first position C, where the crank arm is pivoted downward and appears to be laying flat against the support surface. However, when the crank arm 150 is rotated upward from its first position C, illustrated in FIG. 2, to its second position D, illustrated in FIG. 3, the platform 124 is lifted from its lowered position A to its raised position B. As illustrated in FIG. 3, the platform 124 is positioned in the raised position B, where the platform 124 is positioned within the second opening 118. The platform 124 is sized and shaped identically to that of the second opening 118. When a toy vehicle 700 is positioned on the platform 124, and the platform 124 is in the raised position B, the toy vehicle 700 will extend upward through the second opening 118 and above the top surface 116. As illustrated best by FIG. 3, the platform 124 includes a first depression 126 and a second depression 128. These depressions 126, 128 are configured to receive the wheels of the toy vehicle 700 and partially retain the toy vehicle 700 on the platform 700. In other words, the depressions 126, 128 prevent the toy vehicle 700 from rolling off of the platform 124. Additionally, in the embodiment where the top surface 116 is configured to rotate about a vertical axis with respect to the sidewall 112, the platform 124 is also configured to rotate simultaneously with the top surface 124 about a vertical axis.

Additionally, a spray guard 130 is movably coupled to the back of the chamber 110, at a location opposite from the first opening 114. The spray guard 130 is coupled to the platform 124 and is configured to translate along a linear vertical pathway. Therefore, when the platform 124 is in the lowered position A, the spray guard 130 is positioned behind the chamber 110. Conversely, when the platform 124 is in the raised position B, the spray guard 130 is raised above the top surface 116. As the rotation of the crank arm 150 lowers and raises the platform 124, the rotation of the crank arm 150 simultaneously lowers and raises the spray guard 130.

Figure 4:
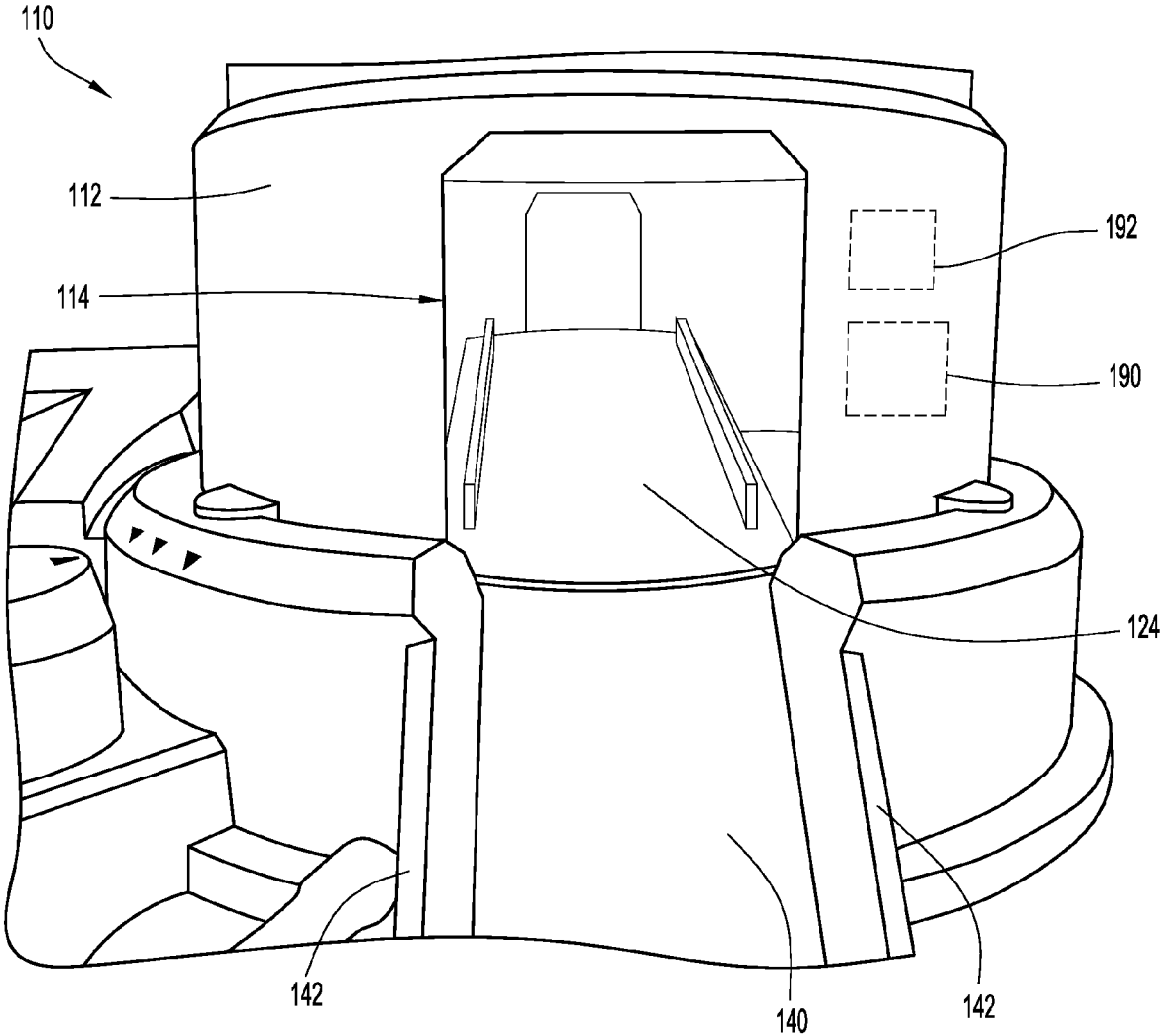
FIG. 4 illustrates a front view of the chamber according to the embodiment of the toy vehicle play set of FIG. 1.

Turning now to FIG. 4, illustrated is a front view of the chamber 110 of the base 100. As illustrated, and discussed previously, the platform 124 aligns with the opening 114 in the sidewall 112 when the platform is in the lowered position A. Furthermore, as best seen in FIG. 4, the ramp 140 is aligned with the first opening 114 and the platform 124. Therefore, as toy vehicles 700 travel along ramp 140, the toy vehicles 700 enter the chamber 110 through the first opening 114 and are positioned onto the platform 124. Additionally, the ramp 140 includes sidewalls 142 that extend upwardly from the sides of the ramp 140. The sidewalls 142 properly align a toy vehicle 700 with the first opening 114 of the chamber 110 and any track section attached to the ramp 140.

Moreover, as best illustrated in FIG. 4, the chamber 110 includes a motor 190 and a fan 192. The motor 190 may be configured to power the fan 192 and provide an air supply to the airbrush gun 200 that is coupled to the base 100. In other embodiments, the motor 190 may be located in a different location on the base 100, such as the holder 170, which is illustrated in FIG. 1. Furthermore, the fan 192 is configured to propel air over the toy vehicle 700 when the toy vehicle 700 is placed on the platform 124 and the platform 124 is in the lowered position A. In use, as later explained in more detail, with the platform 124 in the raised position B and the toy vehicle positioned on the platform 124, the toy vehicle 700 is sprayed by the airbrush 200. Then the platform 124 containing the toy vehicle 700 is lowered into the chamber 110. The fan 192 is then actuated to blow air over the toy vehicle 700 to dry the ink that was recently applied to the toy vehicle 700.

Turning to FIGS. 5 and 6, illustrated is the chamber 110 with the stencil frame 300 pivotally coupled to the top surface 116 of the chamber 110. As best illustrated in FIG. 6, the stencil frame 300 is pivotally coupled to, and configured to pivot about, the set of extensions 120. The stencil frame 300 is configured to pivot between an open position E, illustrated in FIG. 5, and a closed position F, illustrated in FIG. 6. In the open position E, the stencil frame 300 is raised above and is not covering the second opening 118 of the top surface 116 of the chamber 110. Conversely, in the closed position F, the stencil frame 300 is pivoted downwardly from the open position E, to lie across the top surface 116 and cover the second opening 118.

Figure 7:
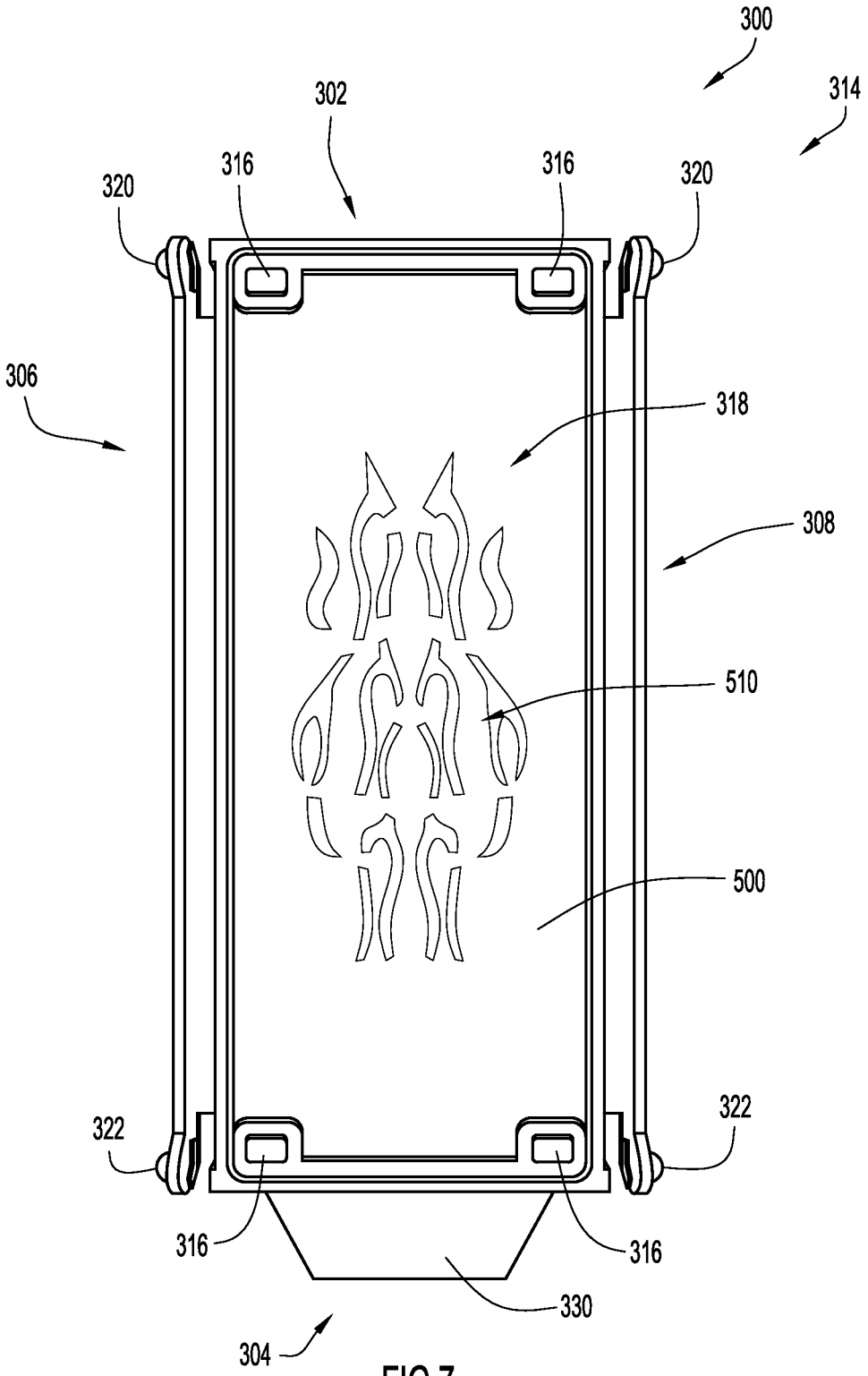
FIG. 7 illustrates a first embodiment of a stencil frame and a resilient stencil attached to the stencil frame to be used with the embodiment of the toy vehicle play set of FIG. 1.
Figure 7A:
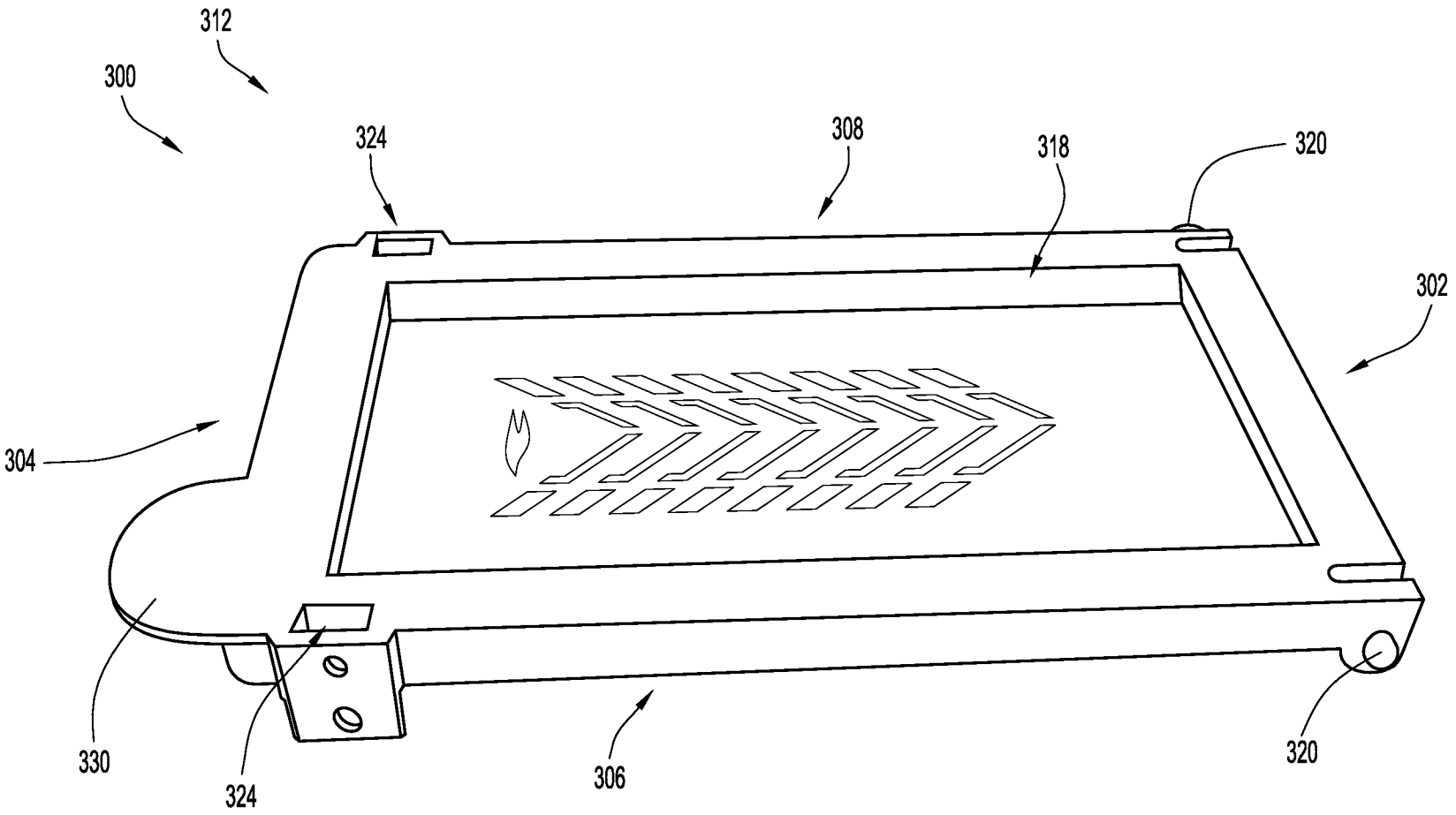
FIG. 7*a* illustrates a second embodiment of a stencil frame and a resilient stencil attached to the stencil frame to be used with the embodiment of the toy vehicle play set of FIG. 1.
Figure 7B:
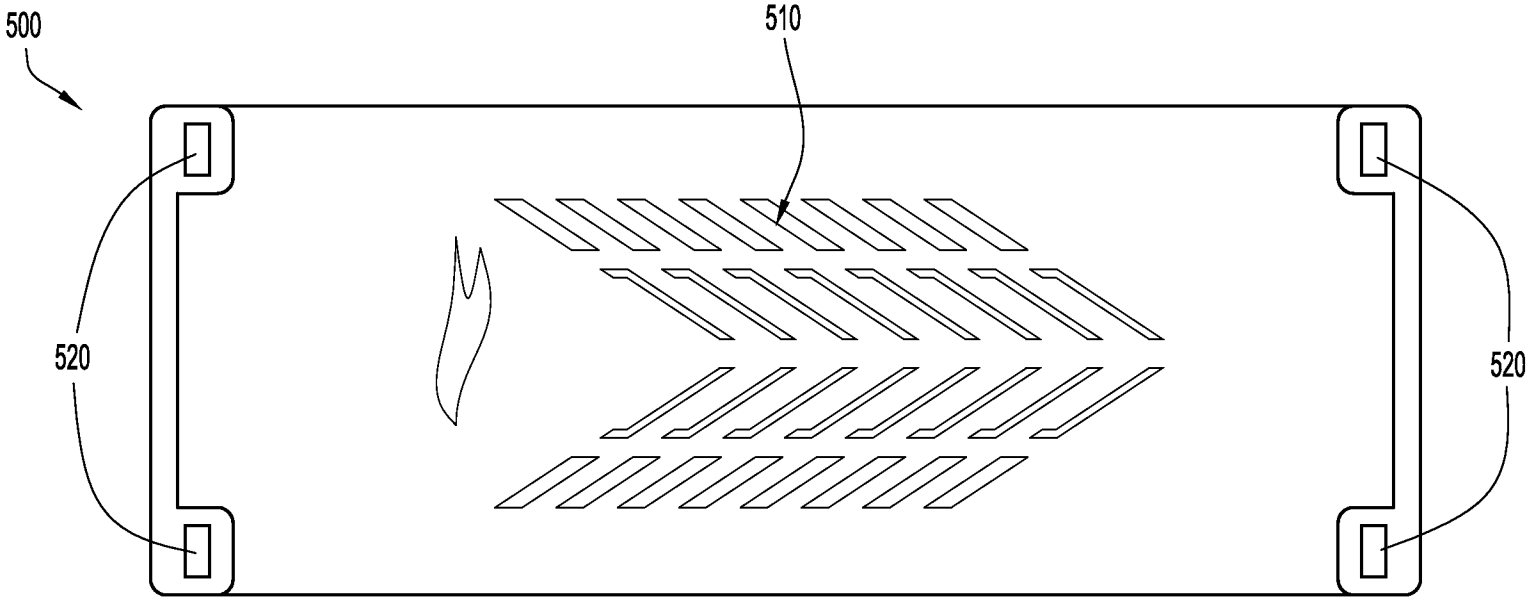
FIG. 7*b* illustrates a resilient stencil that is attachable to the embodiment of the stencil frame illustrated in FIG. 7 and the embodiment of the stencil frame illustrated in FIG. 7*a*.

Turning to FIGS. 7, and 7*a*, illustrated are two different embodiments of the stencil frame 300. Illustrated in FIG. 7, the first embodiment of the stencil frame 300, while illustrated in FIG. 7*b* is the second embodiment of the stencil frame 300. According to both embodiments, the stencil frame 300 is rectangular in shape, similar to that of the second opening 118 in the top surface 116 (illustrated in FIGS. 2 and 3). Furthermore, illustrated in FIG. 7 is the bottom 314 of the stencil frame 300. Both embodiments of the stencil frame 300 include a first short side 302, a second short side 304, a first elongated side 306, and a second elongated side 308. The sides 302, 304, 306, 308 collectively define a rectangular frame 300 that includes a rectangular aperture 318. Moreover, disposed on the corners formed by the first short side 302 and the elongated sides 306, 308 are the first protuberances 320. According to the first embodiment illustrated in FIG. 7, disposed on the corners formed by the second short side 304 and the elongated sides 306, 308 are the second protuberances 322. However, slightly different than the first embodiment is the second embodiment, which has openings 324 disposed on the corners formed by the second short side 304 and the elongated sides 306, 308.

As best illustrated by FIG. 6, the second embodiment of the stencil frame 300 is pivotally coupled to the top surface 116 of the chamber 110 and positioned in the closed position F. As illustrated, the first protuberances 320 of the stencil frame 300 are pivotally coupled to the extensions 120. The first protuberances 320 are configured to interact with the extensions 120, allowing the stencil frame 300 to be coupled to the top surface 116, but still pivot about a horizontal axis that intersects both of the extensions 120. Because the first protuberances 320 are identical to each other for the first and second embodiments of the stencil frame 300, the first protuberances 320 of first embodiment of the stencil frame 300 interact identically with the extensions 120 as described for the first protuberances 320 of the second embodiment of the stencil frame 300. Furthermore, as illustrated by FIG. 6, when the second embodiment of the stencil frame 300 is in the closed position F, the protrusions 122 extending upwardly from the top surface 116 extend into the openings 324 of the second embodiment of the stencil frame 300. The protrusions 122 may frictionally fit within the openings 324 to secure the stencil 300 in the closed position F. Conversely, but not illustrated, when the first embodiment of the stencil frame 300 is coupled to the top surface 116 of the chamber 110 and positioned in the closed position F, the second protuberances 322 interact with the protrusions 122 similarly to that described for the interaction between the first protuberances 320 and the extensions 120.

Figure 7C:
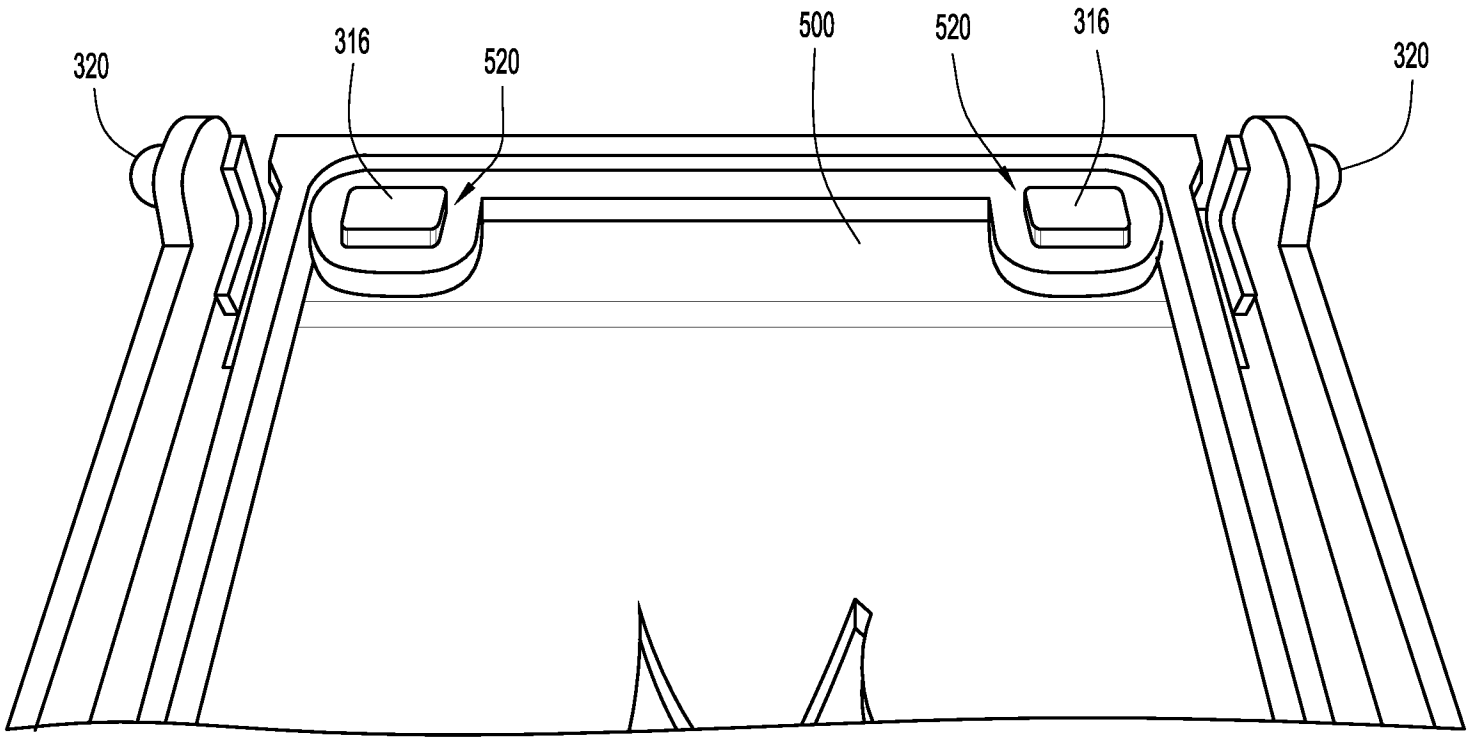
FIG. 7*c* illustrates one end of the embodiment of the stencil frame illustrated in FIG. 7, the resilient stencil being attached to the stencil frame.

Returning to FIGS. 7 and 7*a*, the stencil frame 300 includes a tab 330 that extends from the second short side 304. In the first embodiment of the stencil frame 300, illustrated in FIG. 7, the tab 330 is centrally located on the second short side 304. However, according to the second embodiment of the stencil frame 300, illustrated in FIG. 7*a*, the tab 330 is positioned offset from the center of the second short side 304. Moreover, removably coupled to the stencil frame 300 is a resilient stencil 500. As illustrated in FIG. 7*a*, extending downwardly from the bottom 314 of the stencil frame 300, are four projections 316. A projection 316 is disposed on the bottom 314 of the stencil frame 300 proximate to each one of the corners of the aperture 318. As illustrated in FIGS. 7*b* and 7*c*, the resilient stencil 500 is rectangular in shape and includes an opening 520 at each one of the corners of the resilient stencil 500. As best illustrated in FIG. 7*c*, each one of the openings 520 of the resilient stencil 500 is sized and configured to receive one of the projections 316 extending downwardly from the bottom 314 of the stencil frame 300. The projections 316 frictionally fit within each one of the openings 520, retaining the resilient stencil 500 on the stencil frame 300. When the resilient stencil 500 is coupled to the stencil frame 300, the resilient stencil 500 is configured to lie across and cover the aperture 318 of the stencil frame 300.

Moreover, as illustrated in FIGS. 6, 7, and 7*b*, the resilient stencil 500 includes a stencil design 510. The stencil design 510 is a series of apertures in the resilient stencil 500 that, when viewed together, make up a design. The resilient stencil is constructed from a soft, pliable, but durable resilient material. As illustrated in FIG. 6, a toy vehicle 700 is placed on the platform 124 and the platform is in the raised position B with the toy vehicle 700 extending upwardly from the top surface 116 of the chamber 110. Furthermore, the stencil frame 300, with a resilient stencil 500 coupled to the stencil frame 300, is in the closed position F, and the toy vehicle 700 is located within and extending through the aperture 318 of the stencil frame 300. Because the resilient stencil 500 is coupled to the stencil frame 300 and is resilient, when the stencil frame 300 is in the closed position F over a toy vehicle 700, the resilient stencil 500 is stretched over the toy vehicle 700, as illustrated in FIG. 6. The stencil design 510 is also placed over at least a portion of the toy vehicle 700, enabling a user to use the airbrush 200 (illustrated in FIGS. 1, 8, 8*a*, 8*b*, 8*c*, and 9) to spray ink onto the surface of the toy vehicle 700 according to the stencil design 510. Each one of the apertures that makes up the stencil design 510 allows a portion of the ink sprayed from the airbrush to pass through the resilient stencil 500 and onto the toy vehicle 700.

Figure 8:
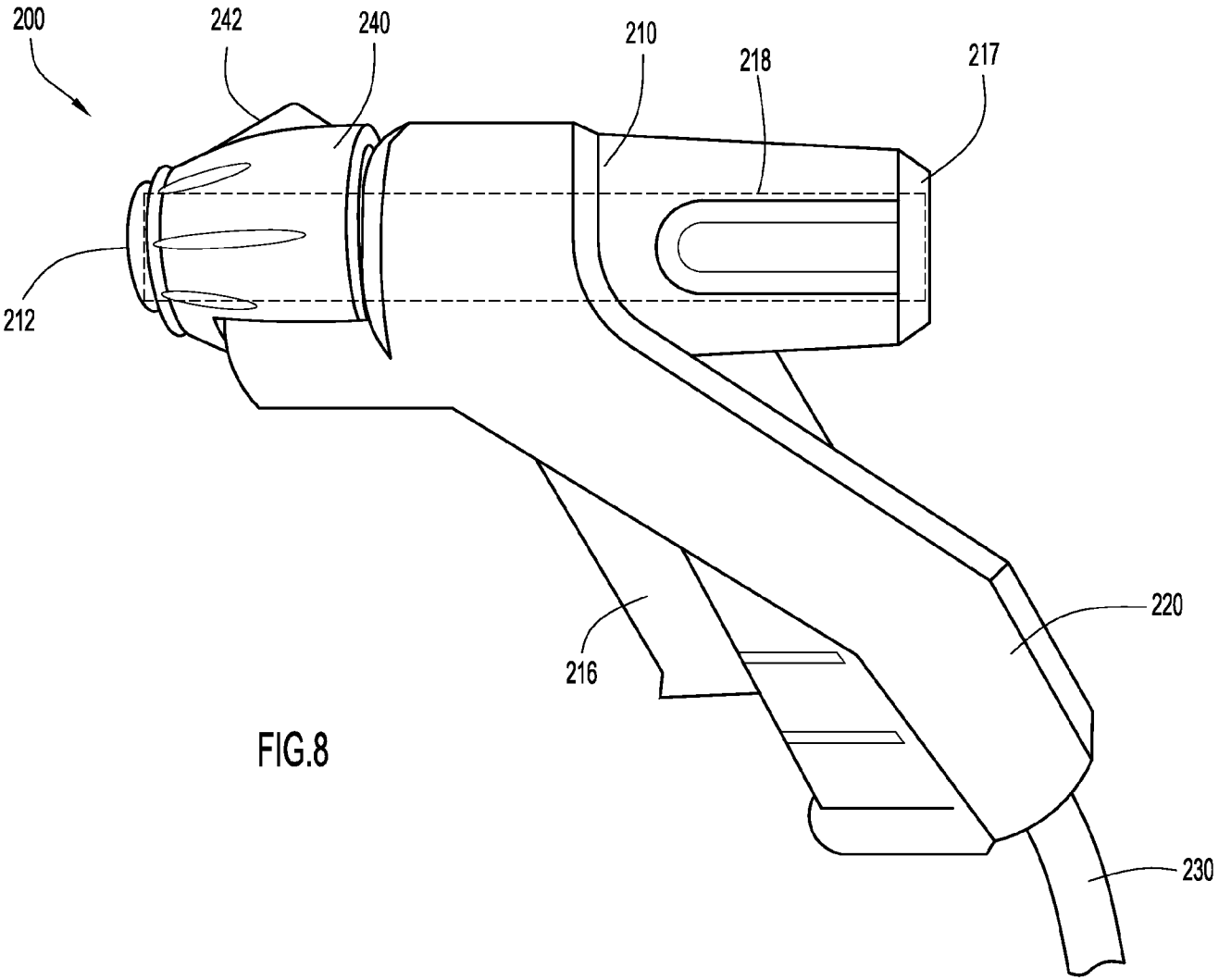
FIG. 8 illustrates a first embodiment of the airbrush to be used with the embodiment of the toy vehicle play set of FIG. 1.
Figure 8B:
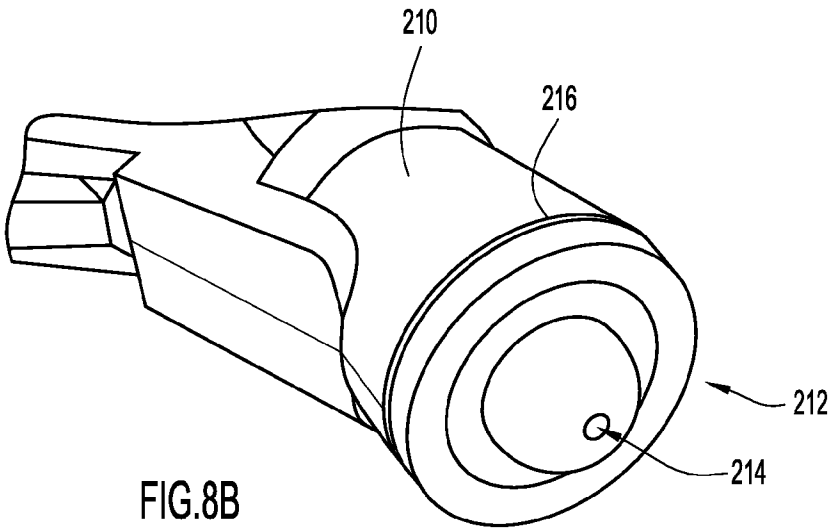
FIG. 8*b* illustrates a second embodiment of a nozzle of an airbrush to be used with the embodiment of the toy vehicle play set of FIG. 1.
Figure 8A:
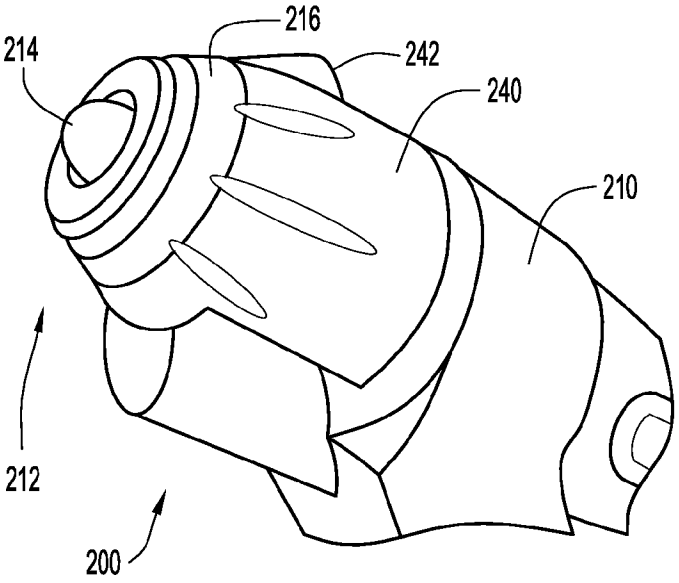
FIG. 8*a* illustrates the nozzle of the first embodiment of the airbrush illustrated in FIG. 8.
Figure 8C:
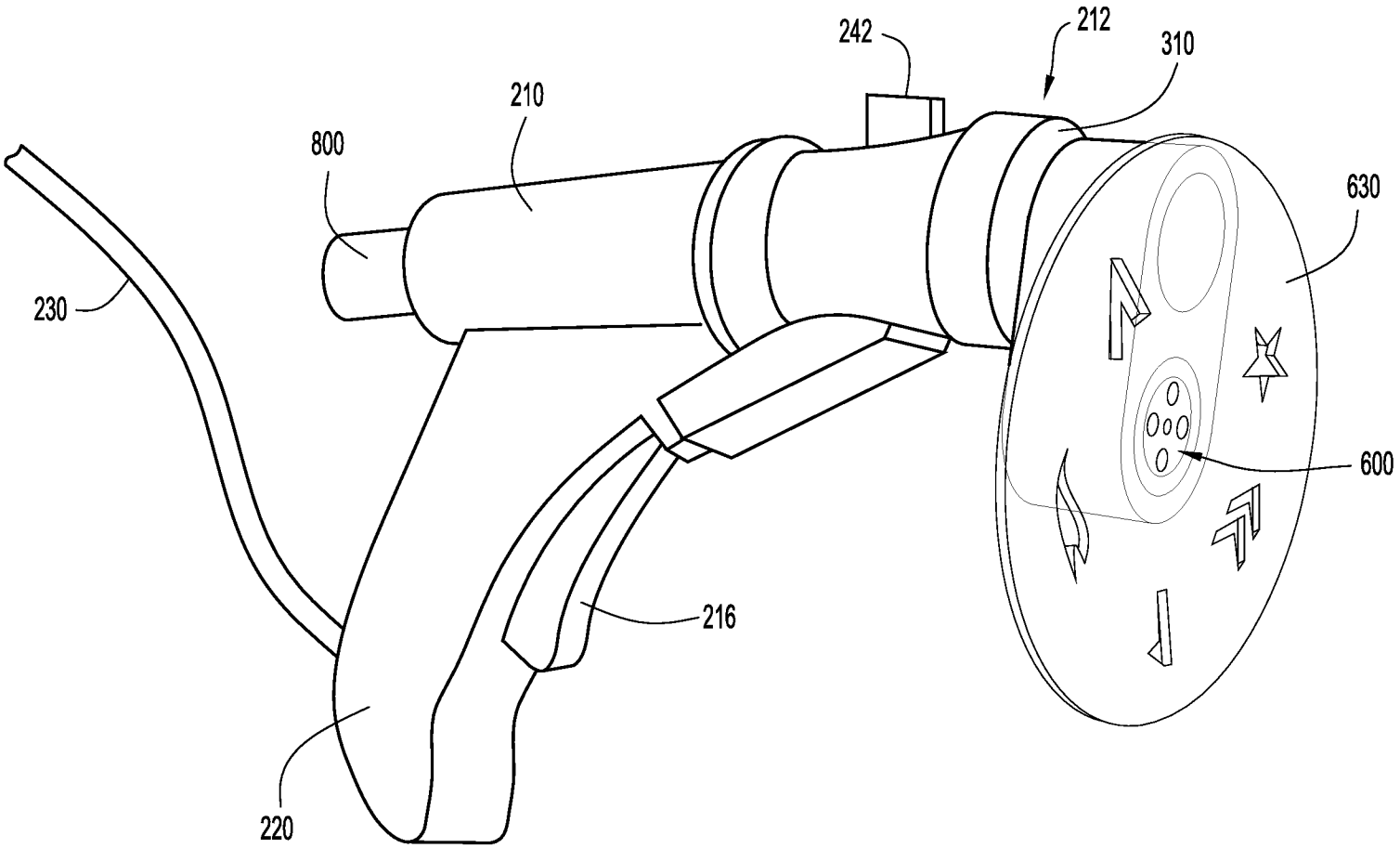
FIG. 8*c* illustrates a second embodiment of the airbrush to be used with the embodiment of the toy vehicle play set of FIG. 1, a stencil attached to the airbrush.

Turning to FIGS. 8 and 8*a*, illustrated is a first embodiment of the airbrush 200. As illustrated, the airbrush 200 has a similar structure to that of a gun. The airbrush 200 includes a barrel 210 and a handle 220. The barrel 210 includes a channel 218 running from the rear 217 of the barrel 210 to the outlet 212 of the barrel 210. The channel 218 is configured to receive a marker 800 inserted into the channel 218 from the rear of the barrel 210, as best illustrated in FIG. 8*c*. The tip of the marker 800 is inserted first into the channel 218, so that when the marker 800 is fully inserted into the channel 218 of barrel 210, the tip of the marker 800 is located proximate to the outlet 212. As illustrated in FIG. 8*c*, the marker 800 may still extend outwardly from the rear 217 of the barrel portion 210 even though the marker 800 is still fully inserted into the channel 218 of the barrel portion 210. Furthermore, as best illustrated in FIG. 8*a*, the outlet 212 includes a nozzle 214 and a circular depression 216 around the end of the outlet 212. The nozzle 214 extends slightly outwardly from the outlet 212. Moreover, the circular depression 216 is configured to secure the circular stencil 600 to the outlet 212 when the circular stencil 600 is placed over the outlet 212.

In addition, according to this embodiment, the outlet 212 includes a dial portion 240. As illustrated, the dial portion 240 is configured to rotate about the end of the barrel portion 210. When the dial portion 240 is rotated, a marker 800 positioned within the channel 218 is translated along the length of the channel 218 positioning the tip of the marker 800 closer to or farther from the outlet 212 and nozzle 214. The dial portion 240 further includes a fin 242 extending outwardly from the dial portion 240. The fin 242 of the dial portion 240 is sized and shaped to be contacted by a user's fingers to allow for easy rotation of the dial portion 240. The fin 242 further serves as an indication to the positioning of the tip of the marker 800 with respect to the outlet 212 and nozzle 214.

In addition, extending out of the bottom from the handle 220 is a cord 230. This cord 230 may transmit air to flow from the base 100 to the airbrush 200. The airbrush 200 then directs the air to flow past the tip of a marker 800 positioned within the channel 218 of barrel 210, and out the nozzle 214 of the outlet 212. This process draws ink particles away from the tip of the marker 800 creating a spray of ink that exits from the nozzle 214 of the outlet 212. The handle 220 further includes a trigger 216 that, when actuated, allow the air from the cord 230 to enter the channel 218 to flow past the tip of the marker 800. Furthermore, when the trigger 216 is not actuated, air in the cord 230 does not flow past the tip of the marker 800. Therefore, when a user wishes to spray an item with ink, the user must actuate the trigger 216.

Illustrated in FIGS. 8*b* and 8*c*, is a second embodiment of the airbrush 200. As best illustrated in FIG. 8*b*, the outlet 212 of the barrel 210 of second embodiment of the airbrush 200 differs from that of the first embodiment of the airbrush 200. As illustrated, the first embodiment of the airbrush 200, the barrel 210 tapers slightly towards the outlet 212, and the outlet 212 includes a dial portion 240 positioned on the outside of the barrel 210. However, as illustrated in FIG. 8*b*, the outlet 212 of the airbrush 200 is substantially cylindrical and does not include a dial portion 240 on the outside of the barrel 210. However, the second embodiment of the airbrush 200 still includes a nozzle 214 and a circular depression 216 extending around the barrel portion proximate to the outlet 212. As best illustrated in FIG. 8*c*, even though the second embodiment of the airbrush 200 does not include a dial portion 240 outside of the barrel 210, a fin 242 extends from the barrel 210 that serves the same purpose as previously described for the dial portion 240 and the fin 242 of the first embodiment of the airbrush 200.

Figure 9:
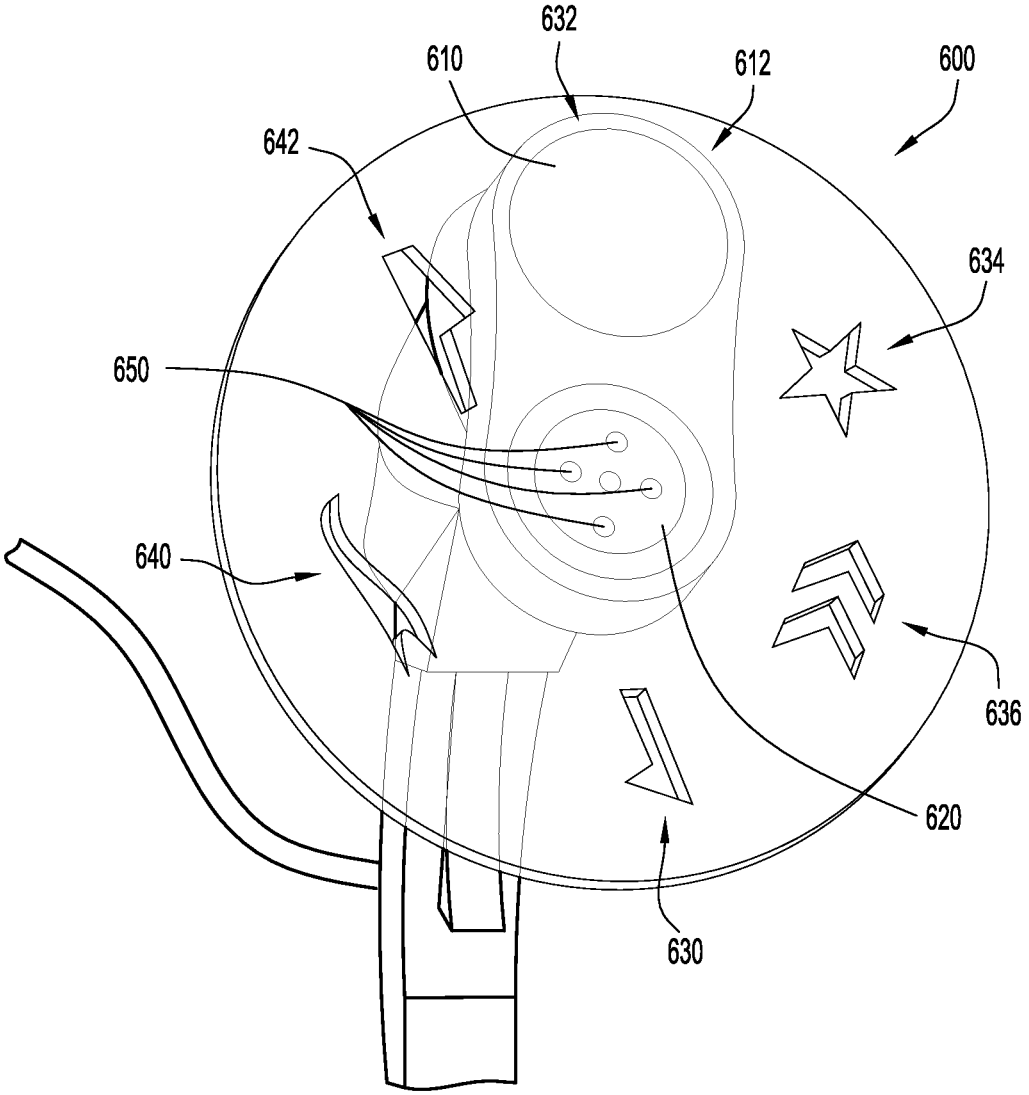
FIG. 9 illustrates an embodiment of the stencil attachable to the first embodiment of the airbrush illustrated in FIG. 8 and the second embodiment of the airbrush illustrated in FIG. 8*c*.

Referring to FIGS. 8*c* and 9, illustrated is a circular stencil 600 that is coupled to the outlet 212 of the airbrush 200. The circular stencil 600 includes an attachment portion 610 and a stencil 630. The attachment portion 610 is configured to have the outlet 212 of the airbrush 200 inserted into the attachment portion 610. A portion of the interior of the attachment portion 610 may snap into the circular depression 216, illustrated in FIGS. 8*a* and 8*b*. As best illustrated in FIG. 9, the attachment portion 610 includes an outlet 612 and a dial 620 positioned below the outlet 612. The outlet 612 of the attachment portion 610 is in fluid communication with the nozzle 214 of the outlet 212 of the airbrush 200. Therefore, when ink is sprayed out of the nozzle 214, and the circular stencil 600 is attached to the airbrush 200, the ink is also sprayed out from the outlet 612 of the attachment portion 610. Attached to the dial 620 is the stencil 630 via four screws 650. The dial 620 is configured to rotate within the attachment portion 610, which rotates the stencil 630 in front of the outlet 612 of the attachment portion 610. Moreover, the stencil 630 includes six designs 632, 634, 636, 638, 640, 642. Furthermore, each one of the stencil designs 632, 634, 636, 638, 640, 642 is different from each other. As illustrated in FIG. 9, each one of the stencil designs 632, 634, 636, 638, 640, 642 is configured rotate into a position adjacent to the outlet 612 of the attachment portion 610. Therefore, the ink can be sprayed from the airbrush 200 in a pattern that mimics the design 632, 634, 636, 638, 640, 642 on the stencil 630 that is positioned adjacent to the outlet 612 of the attachment portion 610.

Referring back to FIGS. 1 and 5, coupled to the chamber 110 and also forming part of the base 100 is holder 170. As illustrated, holder 170 includes a cavity 172 with sidewalls 174 located in the center of the holder 170. The cavity 172 is sized and configured to store multiple different items, including additional resilient stencils 500, or other toy vehicles 700. Located behind the cavity 172 is a plurality of apertures 176. Each one of the apertures 176 is configured to store a marker 800 (not shown) in a substantially upright configuration when the markers 800 are not in use. In addition, extending forward from the front of the holder 170 is extension 178, which includes a holster cavity 182, and a stencil cavity 184. As best illustrated in FIG. 1, the holster cavity 182 is sized and configured for the airbrush 200 to be inserted into the holster cavity 182 when the airbrush 200 is not in use. Also best illustrated in FIG. 1, the stencil cavity 184 is sized and configured for the circular stencil 600 to rest within the holster cavity 182 when the circular stencil 600 is not in use. Finally, coupled to the base of the chamber 110 is a dial 160. The dial 160 includes an indicator 162. The dial 160 is configured to rotate about a vertical axis, and rotation of the dial 160 may actuate the motor 190, fan 192, and/or may direct power to the airbrush 200.

To use the toy vehicle play set 10, a user pushes a toy vehicle 700 into the chamber 110, via the ramp 140 and first opening 114, and onto the platform 124, which is in the lowered position A. The user then rotates the crank arm 150 from the first position C to the second position D, which simultaneously raises the platform 124 from the lowered position A to the raised position B, where the platform 124 is positioned within the second opening 118 on the top surface 116 of the chamber 110. As stated previously, this results in the toy vehicle 700 extending upwardly from the platform 124 above the top surface 116. The user then pivots the stencil frame 300, with attached resilient stencil 500, from the open position E to the closed position F. With the stencil frame 300 in the closed position F, the resilient stencil 500 is configured to flex over the toy vehicle 700, forming a shape similar to that of the toy vehicle 700. As stated previously, this is best illustrated in FIG. 6. The user then utilizes the airbrush 200, without the circular stencil 600, to spray the resilient stencil 500 and the toy vehicle 700. Once the user is done spraying the resilient stencil 500 and toy vehicle 700, the user rotates the crank arm 150 back to the first position C, which lowers the platform 124 to the lowered position A. The user then actuates the fan 194 by turning dial 160 to dry the newly applied ink to the toy vehicle 700. The toy vehicle 700 is then rolled out of the chamber 110 with a newly acquired "paint job." If the user wishes to further customize the paint job of the toy vehicle 700, the user will then attach the circular stencil 600 to the nozzle 212 of the airbrush 200. The user can then rotate the dial 620 so the desired design 632, 634, 636, 638, 640, 642 is positioned adjacent to the outlet 612 of the circular stencil 600. The user may then aim the airbrush 200 with the circular stencil 600 at the toy vehicle to mark the toy vehicle with ink shaped to the design 632, 634, 636, 638, 640, 642 that was chosen.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Therefore, although the disclosed inventions are illustrated and described herein as embodied in one or more specific examples, it is nevertheless not intended to be limited to the details shown, since various modifications and structural changes may be made therein without departing from the scope of the inventions. Further, various features from one of the embodiments may be incorporated into another of the embodiments. Accordingly, it is appropriate that the invention be construed broadly and in a manner consistent with the scope of the disclosure.

What is claimed is:

1. A play set for toy vehicles, comprising:

a chamber including an interior, an exterior, and a top surface with an aperture;

a platform movably coupled to the chamber, the platform moving between a lowered position within the chamber and a raised position where the platform is positioned within the aperture on the top surface of the chamber;

a frame pivotally coupled to the top surface of the chamber at a location proximate to the aperture, the frame being pivotal between an open position and a closed position where the frame is positioned over the aperture in the top surface; and a resilient membrane removably coupled to the frame, the resilient member being positioned over the aperture in the top surface when the frame is in the closed position.

2. The play set of claim 1, wherein the top surface of the chamber is rotatably disposed on the chamber and configured to rotate about a vertical axis.

3. The play set of claim 2, wherein the platform is configured to rotate simultaneously with the top surface about the vertical axis.

4. The play set of claim 1, further comprising:

a lever operatively coupled to the platform and the chamber, the lever being configured to move the platform between the lowered position and the raised position.

5. The play set of claim 4, wherein the lever is configured to pivot between a first position and a second position, when the lever is in the first position, the platform is in the lowered position, and when the lever in the second position, the platform is in the raised position.

6. The play set of claim 1, wherein the chamber further comprises:

a motor.

7. The play set of claim 6, wherein the chamber further comprises:

a fan powered by the motor, the fan being configured to propel air over the platform when the platform is in the lowered position.

8. The play set of claim 6, further comprising:

an airbrush powered by the motor.

9. The play set of claim 1, wherein the resilient membrane further comprises a series of apertures that, when viewed together, create a design.

10. The play set of claim 1, wherein the resilient member is configured to stretch and deform over a toy vehicle when the toy vehicle is positioned on the platform, the platform is positioned in the raised position, and the frame is in the closed position.

11. A play set, comprising:

a housing;

a frame pivotally coupled to the housing, the frame being pivotal between an open position and a closed position where an object can be positioned beneath the frame; and a resilient membrane coupled to the frame, the resilient member laying over the object when the frame is in the closed position.

12. The play set of claim 11, wherein the resilient membrane is removably coupled to the frame.

13. The play set of claim 11, wherein the frame includes several projections and the resilient membrane includes several openings, each of the openings receive a projection when the resilient membrane is coupled to the frame.

14. The play set of claim 11, wherein the resilient membrane further comprises a series of apertures that, when viewed together, create a design.

15. The play set of claim 11, wherein the resilient member is configured to stretch and deform over the object when the frame is in the closed position.

16. A play set for toy vehicles, comprising:

a housing;

a platform coupled to the housing, the platform being configured to receive a toy vehicle thereon;

a frame movably coupled to the housing, the frame being movable between an open position and a closed position relative to the housing; and a resilient membrane removably coupled to the frame, the resilient member being configured to stretch and deform over the toy vehicle on the platform when the frame is in the closed position and the resilient membrane is coupled to the frame, the resilient membrane defining at least one opening through which a material may contact the toy vehicle.

17. The play set of claim 16, wherein the housing includes an opening formed therein, the platform is located proximate to the opening of the housing, and the frame is located proximate to the opening of the housing.

18. The play set of claim 16, wherein the resilient membrane includes several mounting openings and the frame includes several projections, each of the projections being inserted into one of the mounting openings of the resilient membrane when the resilient membrane is coupled to the frame.

19. The play set of claim 16, further comprising:

an airbrush coupled to the chamber, the airbrush configured to spray ink from a marker inserted into the airbrush.

20. The play set of claim 16, wherein the resilient membrane further comprises a series of apertures that, when viewed together, create a design.

* * * * *